United States Patent [19]

Nishioka et al.

[11] 3,987,389

[45] Oct. 19, 1976

[54] VARIABLE RESISTOR DEVICE

[75] Inventors: Matsuo Nishioka; Shunzo Oka, both of Kadoma, Japan

[73] Assignee: Matsushita Electric Industrial Co., Ltd., Japan

[22] Filed: Dec. 27, 1974

[21] Appl. No.: 536,993

[30] Foreign Application Priority Data

| | | |
|---|---|---|
| Dec. 27, 1973 | Japan | 49-64[U] |
| Dec. 27, 1973 | Japan | 49-65 [U] |
| Dec. 27, 1973 | Japan | 49-66[U] |
| Dec. 27, 1973 | Japan | 49-67[U] |
| Dec. 27, 1973 | Japan | 49-68[U] |
| Dec. 27, 1973 | Japan | 49-69[U] |
| Dec. 27, 1973 | Japan | 49-70[U] |
| Dec. 27, 1973 | Japan | 49-71[U] |

[52] U.S. Cl. ..... 338/180; 338/184; 338/202

[51] Int. Cl.[2] ..... H01C 9/02

[58] Field of Search ..... 338/118, 148, 160, 165, 338/166, 176, 180, 181, 182, 183, 184, 194, 202

[56] References Cited

UNITED STATES PATENTS

| | | | |
|---|---|---|---|
| 3,639,879 | 2/1972 | Rooijen | 338/180 |
| 3,742,421 | 6/1973 | Rooijen | 338/180 |
| 3,815,076 | 6/1974 | Aoki | 338/180 |
| 3,868,621 | 2/1975 | Kitamura et al. | 338/180 |
| 3,918,023 | 11/1975 | Zdamys | 338/180 |

*Primary Examiner*—Volodymyr Y. Mayewsky
*Attorney, Agent, or Firm*—Robert E. Burns; Emmanuel J. Lobato; Bruce L. Adams

[57] ABSTRACT

Herein disclosed is a variable resistor device which may be used as a tuner in an electric appliance such as a television receiver and a stereophonograph, which resistor device comprises a support member having a base wall portion and at least one end wall portion perpendicular to the base wall portion, an elongate resistance element on the inner face of the base wall portion, a control shaft rotatable on the end wall portion and having a threaded axial portion extending over the resistance element, a slider having a contact portion elastically forced against the resistance element and an edge portion in mating engagement with the threaded axial portion of the control shaft for providing electrical connection between the resistance element and the shaft, and an electrically conductive retainer for holding the control shaft in position relative to the support member while permitting the control shaft to rotate about its axis. Features of the device include ease of assemblage and reliability of operation.

25 Claims, 11 Drawing Figures

VARIABLE RESISTOR DEVICE

The present invention relates in general to variable resistor devices and, in particular, to a variable resistor device which is adapted to produce electrical resistance which is variable by rotary manipulative actions applied to the resistor device. The variable resistor device of this nature is applicable, for example, to a tuner for use in an electric appliance such as a television receiver and a stereophonograph.

A known example of the variable resistor device of the nature above mentioned uses a control shaft which is inserted through holes formed in a support member or structure so that not only a disproportionately large number of time-consuming steps are required for the assemblage of such a device but a problem is encountered during use of the device in that the control shaft is apt to be axially or radially moved from its initial position relative to the support member. This has resulted in an increased production cost of the variable resistor device and in instability of operation.

It is, therefore, an important object of the present invention to provide an improved variable resistor device which can be easily assembled by a reduced number of steps.

It is another important object of the invention to provide an improved variable resistor device which is simple in construction and economical to manufacture.

It is still another important object of the present invention to provide an improved variable resistor device which will provide reliable and stabilized performance characteristics.

In accordance with the present invention, these objects will be accomplished in a variable resistor device which comprises a support member having a base wall portion and at least one end wall portion projecting substantially perpendicularly from a longitudinal end of the base wall portion and formed with an elongate recess terminating with a substantially semicircularly curved edge, an elongate resistance element which is fixedly secured to an inner face of the base wall portion of the support member and which extends longitudinally of the base wall portion, an electrically conductive control shaft which is rotatably received on the semicircularly curved edge of the end wall portion of the support member and which has a threaded axial portion extending substantially in parallel with and over the resistance element, electrically conductive retaining means snugly and releasably fitted to the end wall portion of the support member and engaging the control shaft for holding the control shaft in position relative to the support member while permitting the control shaft to rotate about its axis on the end wall portion of the support member, and an electrically conductive slider which is longitudinally movable over the inner face of the base wall portion of the support member and which has an elastic contact portion elastically forced and longitudinally slidable on the resistance element and an edge portion which is in mating engagement with the threaded axial portion of the control shaft, the slider being longitudinally moved on the resistance element with its edge portion kept in mating engagement with the threaded axial portion of the control shaft when the control shaft is driven for rotation about its axis so that the edge portion of the slider is moved longitudinally on the threaded axial portion in parallel to the axis of the control shaft.

The variable resistor device according to the present invention may further comprise a casing member which is snugly fitted to the support member and enclosing the resistance element, the threaded axial portion of the control shaft and the slider within the casing member and the support member.

The control shaft forming part of the variable resistor element thus constructed may be formed with a radially inwardly stepped or reduced axial portion projecting outwardly from an outer face of the end wall portion of the support member. In this instance the above mentioned retaining means comprises an elastically deformable, electrically conductive retaining member which has spaced portions snugly and releasably fitted to the end wall of the support member and an end portion which has a substantially semicircularly curved part on which the stepped or reduced axial portion of the control shaft is circumferentially slidably received.

The support member also forming part of the variable resistor device according to the present invention may further has a pair of spaced parallel guide rail portions on the inner face of the base wall portion of the support member and extending longitudinally of the base wall portion and on both sides of the elongate resistance element. In this instance, the previously mentioned slider has a main wall portion which is substantially parallel to the inner face of the base wall portion of the support member and which is formed with the previously mentioned contact portion elastically forced against the resistance element and a pair of side wall portions projecting substantially perpendicularly from the longitudinal edges of the main wall portion of the slider and respectively in longitudinally slidable contact with the guide rail portions of the support member. In this instance, the main wall portion of the slider may be partly removed so as to form a pair of strip portions which arcuately extend toward the resistance element and interconnected at their respective leading ends for forming the previously mentioned contact portion elastically forced against the resistance element.

The slider incorporated into the variable resistor device according to the present invention may, otherwise, consist essentially of a first end portion formed with an opening partly defined by the previously mentioned edge portion in mating engagement with the threaded axial portion of the control shaft, a second end portion having a substantially flat face in slidable contact with the threaded axial portion of the control shaft, and an arcuately warped intermediate portion which interconnects the first and second end portions and which is formed at its top with the previously mentioned contact portion elastically forced against the resistance element.

The control shaft may be provided with a disc member which is fixedly carried on the shaft and which has one face in slidable contact with the inner face of the end wall portion of the support member. If, in this instance, the variable resistor device according to the present invention includes the casing member as previously mentioned, the casing member may have a main wall portion which has a longitudinal end in close contact with the inner face of the end wall portion of the support member and which is formed with a projection on its inner face so that the other face of the above mentioned disc member is in slidable contact with the projection of the main wall portion of the casing member.

Other features and advantages of the variable resistor device according to the present invention will become apparent from the following description taken in conjunction with the accompanying drawings, in which.

Figure 2:
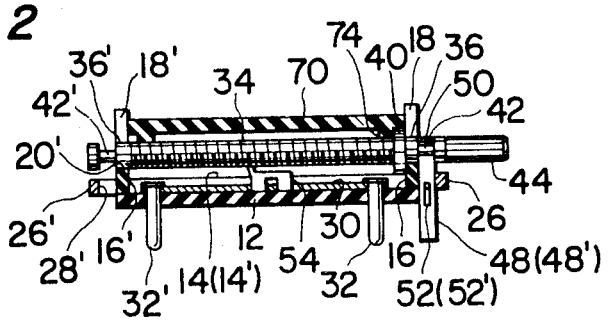
FIG. 2 is a longitudinal sectional view of the variable resistor device illustrated in FIG. 1.
Figure 3:
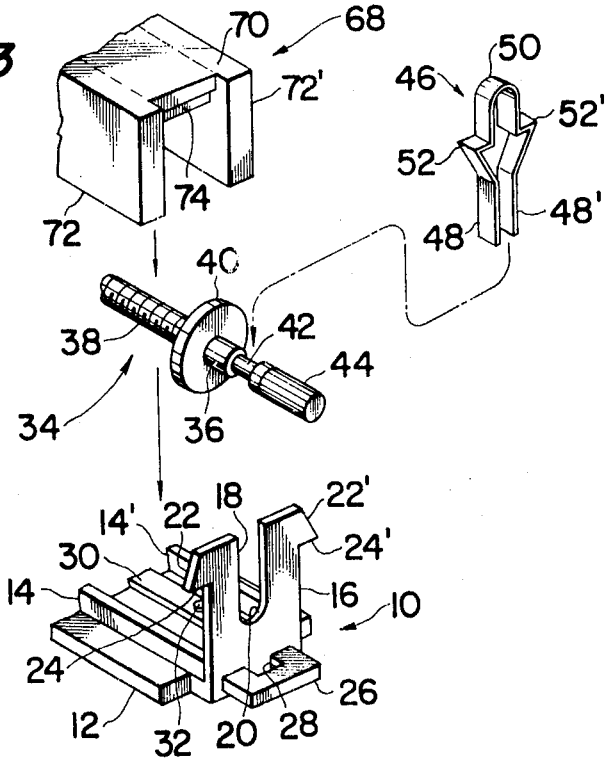
FIG. 3 is a fragmentary exploded view which shows examples of detailed constructions of and positional relations between a support member, a control shaft, a retaining member and a casing member forming part of the variable resistor device shown in FIGS. 1 and 2.
Figure 5A:
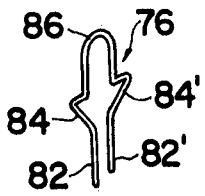
Figure 5B:
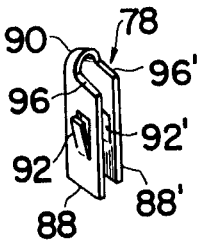
Figure 5C:
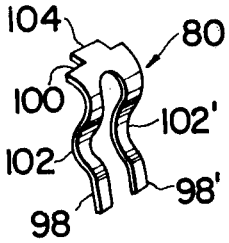
Figure 6:
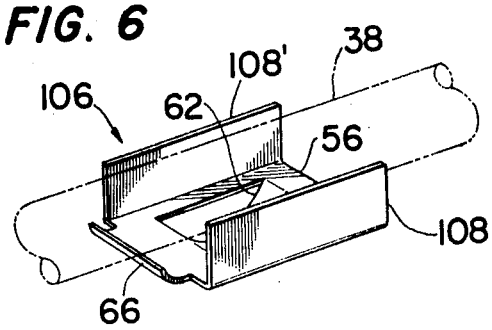
Figure 7:
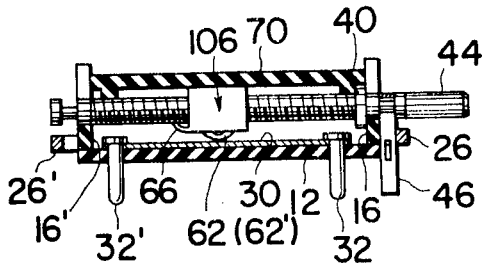
Figure 8:
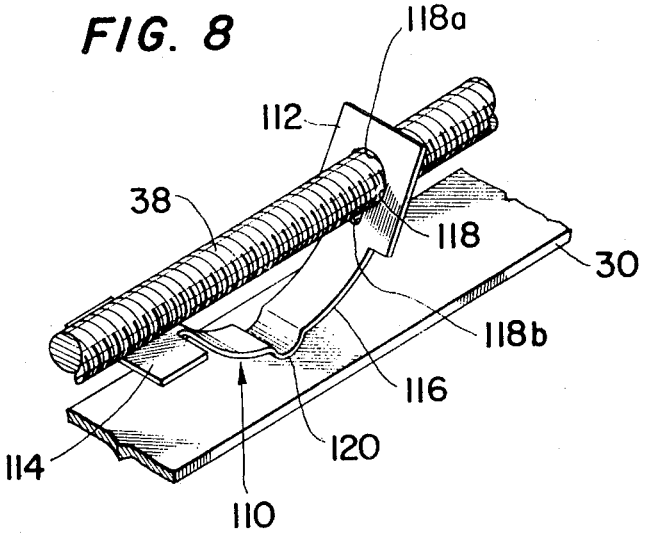
Figure 9:
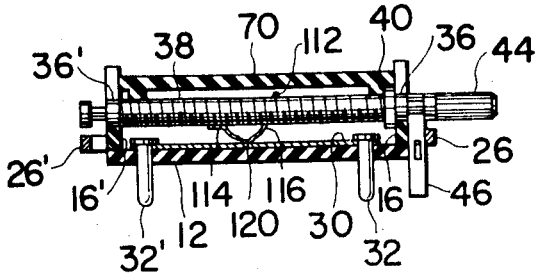

FIGS. 5*a*, 5*b* and 5*c* are perspective views respectively showing alternative examples of the retaining member shown in FIG. 3;

FIG. 6 is a perspective view showing another preferred example of the detailed configuration of the slider forming part of a variable resistor device embodying the present invention;

FIG. 7 is a view similar to FIG. 2 but now shows the variable resistor device incorporating the slider illustrated in FIG. 6;

FIG. 8 is a perspective view showing still another preferred example of the detailed configuration of the slider forming part of the variable resistor device embodying the present invention;

FIG. 9 is a view also similar to FIG. 2 but shows the variable resistor device incorporating the slider illustrated in FIG. 8.

Throughout the figures of the drawings, like reference numerals designate corresponding parts and members.

Referring to the drawings, particularly to FIGS. 1 to 4, the variable resistor device embodying the present invention comprises a unitary support member 10 formed of an electrically insulating material. The support member 10 has an elongated base portion 12 and a pair of spaced parallel guide rail portions 14 and 14′ formed on an inner or, as shown, upper face of the base wall portion 12 and respectively extending along and appreciably spaced apart from the longitudinal edges of the base wall portion 12, as will be best seen from FIG. 3. The guide rail portions 14 and 14′ are assumed to have substantially rectangular cross sections. The support member 10 is further formed with a pair of end wall portions 16 and 16′ respectively extending substantially perpendicularly from the longitudinal ends of the base wall portion 12 as shown in FIG. 2 and as will be more clearly seen from FIG. 3 in which only one of the end wall portions 16, is illustrated. The end wall portion 16 shown in FIG. 3 has an elongate recess 18 extending from its free end toward the longitudinal end of the base wall portion 12 and terminating with a substantially semicircularly curved edge 20 which is located halfway of the end wall portion 16. The end wall portion 16 is shown in FIG. 3 as being further formed with a pair of side projections 22 and 22′ projecting sidewise from a leading end portion of the end wall portion 16. The side projections 22 and 22′ have substantially flat lower edges 24 and 24′, respectively, which confront the longitudinal ends of the base wall portion 12 and which are substantially parallel to and spaced apart a predetermined distance from the longitudinal end of the inner or upper face of the base wall portion 12. The detailed configuration of the end wall portion 16′ projecting from the other longitudinal end of the base wall portion 12 is not shown in the drawings but may be assumed, for convenience sake, to be essentially similar to that of the end wall portion 16 above described. The end wall portion 16′ is, thus, shown in FIG. 2 as being formed with an elongate recess 18′ terminating at a substantially semicircularly curved edge 20′ which is aligned, longitudinally of the support member 10, with the semicircularly curved edge 20 of the first named end wall portion 16. As seen in FIGS. 2 and 3, the end wall portion 16 is further formed with a projection 26 projecting in a longitudinal direction of the support member 10 from the outer face of the end wall portion 16. The projection 26 is formed with an opening 28 which is located in the neighbourhood of the curved edge 20 of the end wall portion 16 and which is oriented in a direction substantially parallel to the direction in which the elongate recess 18 in the end wall portion 16 extends. If desired, the end wall portion 16′ opposite to the end wall member 16 may also be formed with a projection 26′ which is arranged essentially similarly to the above mentioned projection 26 and which is thus formed with an opening 28′. Although the support member 10 has been assumed to be of a unitary construction, the guide rail portions 14 and 14′ and/or the end wall portions 16 and 16′ may be formed separately of each other and connected together by suitable fastening means, if desired. Likewise, the projections 24 and 24′ and/or the projection 26 which have been assumed to be integral with the end wall portion 16 may be formed separately of the end wall portion 16 and connected to the end wall portion 16 by suitable fastening means. It is apparent that the other end wall portion 16′ may also be arranged in this manner if desired.

On the inner or upper face of the base wall portion 12 of the support member 10 thus constructed is fixedly attached an elongate resistance element 30 extending between the guide rail portions 14 and 14′ longitudinally of the base wall portion 12, as will be seen from FIGS. 2 and 3. The resistance element 30 is secured at its longitudinal ends to the inner or upper face of the base wall portion 12 by a pair of fittings 32 and 32′, as shown in FIG. 2. The fittings 32 and 32′ provide terminals of the resistance element 30 and are connected to lead wires though not shown in the drawings.

The variable resistor device embodying the present invention further comprises a control shaft 34 formed of an electrically conductive material. As will be seen from FIG. 2, the control shaft 34 has a first journal portion 36 located in the neighborhood of one axial end of the shaft 34 and a second journal portion 36′ located at the other end of the shaft 34. The journal portions 36 and 36′ are circumferentially slidably received on the previously mentioned semicircularly curved edges 20 and 20′ of the end wall portions 16 and 16′, respectively, of the support member 10 so that the control shaft 34 is rotatable about its axis on the semicircularly curved edges 20 and 20′ of the end wall portions 16 and 16′, the curved edges 20 and 20′ thus forming bearing portions for the shaft 34. The control shaft 34 further has a threaded axial portion 38 extending between the above mentioned journal portions 36 and 36′ and over the entire length of the elongate resistance element 30 on the inner or upper face of the base wall portion 12 of the support member 10. The control shaft 34 has fixedly carried thereon a disc member 40 which is located at one end of the threaded axial portion 38 adjacent the first journal portion 36 as will be best seen from FIG. 3. The disc portion 40 is slidably received on the inner face of the end wall portion 16 and has a diameter which is appropriately larger than the width of the elongate recess 18 formed in the end wall portion 16. The control shaft 34 is further formed with a radially stepped or reduced axial portion 42 extending in an opposite direction from the foremost end of the first journal portion 36. The reduced axial portion 42 of the control shaft 34 thus projects axially outwardly from the end wall portion 16 of the support member 10 and is located over and substantially aligned with the opening 28 formed in the projection 26 on the end wall portion 16. The control shaft 34 is connected at the foremost end of the reduced axial portion 42 to a control knob 44 which is formed of an electrically insulating material. The control knob 44 is provided to drive the control shaft 34 for rotation about its axis from the outside of the variable resistor device.

Figure 1:
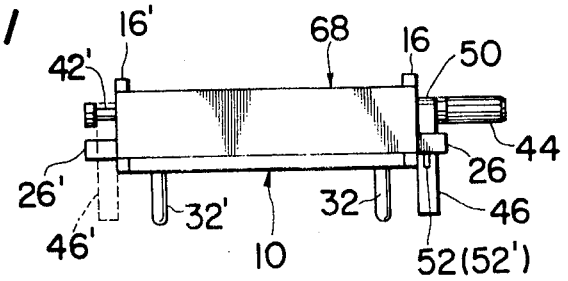
FIG. 1 is a side elevational view of the variable resistor device embodying the present invention.

The variable resistor embodying the present invention further comprises a retaining member 46 for holding the control shaft 34 in position relative to the support member 10 and providing electrical connection between the electrically conductive control shaft 34 and an external electric circuit (not shown). The retaining member 46 is formed of an electrically conductive and, preferably, elastic material and, as will be clearly seen in FIG. 3, has a pair of spaced, generally parallel arm portions 48 and 48′ which marge into each other through a rounded or substantially semicircularly curved end portion 50. The rounded or semicircularly curved end portion 50 has a radius of curvature which is substantially equal to the radius of the reduced axial portion 42 of the control shaft 34 and so that the reduced axial portion 42 is circumferentially slidably received on the inner surface of the rounded or semicircularly curved end portion 50. It is apparent that the rounded or semicircularly curved end portion 50 of the retaining member 46 has a width which is substantially equal to or appreciably smaller than the axial length of the reduced axial portion 42 of the control shaft 34 so that the control shaft 34 is prevented from being dislodged from its axial position relative to the support member 10 when engaged by the retaining member 46. The arm portions 48 and 48′ have sidewise outwardly bent or protruded intermediate sections 52 and 52′, respectively, which are configured in such a manner as to be capable of being passed through the opening 28 in the projection 26 of the end wall portion 16 of the support member 10 when the retaining member 46 is laterally contracted or, in other words, the arm portions 48 and 48′ are forced toward each other against by an external force against and opposing force exerted by the rounded or semicircularly curved end portion 50. Once the bent or protruded intermediate sections 52 and 52′ of the retaining member 46 are thus inserted through the opening 28 in the projection 26 of the end wall portion 16 of the support member 10 with the reduced axial portion 42 of the control shaft 34 rotatably received on the inner surface of the rounded or semicircularly curved end portion 50 of the retaining member 46 and is released from the external force which has been effective to laterally contract the retaining member 46, the sections 52 and 52′ are allowed to be spaced wider from each other in their initial positions by reason of the spring action of the rounded or semicircularly curved end portion 50 and are closely forced against the lower face of the projection 26 so that the retaining member 50 in its entirety is snugly fitted to the projection 26 of the end wall portion 16 of the support member 10. The outwardly bent or protruded sections 52 and 52′ of the retaining member 46 are shown in FIG. 3 as having flat faces which are substantially flush with each other and which substantially perpendicularly join the outer faces of the parallel upper sections of the arm portions 52 and 52′ and inclined faces which approach each other toward the lower parallel sections of the arm portions 52 and 52′, respectively. When the outwardly bent or protruded sections 52 and 52′ are inserted through the opening 28 in the projection 26 of the end wall portion 16, the retaining member 46 is snugly fitted to the projection 26 with the flat upper faces of the sections 52 and 52′ held in close contact with the lower face of the projection 26. The configuration of the retaining member 46 above described is merely by way of example and, therefore, may be modified in numerous manners as will be described later.

Where desired, the retaining member having the above described configuration may also be fitted to the other end portion of the control shaft 34 as shown at 46′ in FIG. 1. In this instance, the control shaft 34 is formed with a second radially inwardly stepped or reduced axial portion 42′ adjacent to the second journal portion 36′ of the control shaft 34 and, in addition thereto, the end wall portion 16′ of the support member 10 is further formed with a projection 26′ projecting outwardly from the outer face of the end wall portion 16′, as will be best seen from FIG. 2. Similarly to the projection 26 formed on the first end wall portion 16 of the support member 16, the projection 26′ on the second end wall portion 16′ is formed with an opening 28′ which is substantially aligned with the reduced axial portion 42′ of the control shaft 34 so that the second retaining member 46′ is snugly fitted to the projection 26′ on the second end wall portion 16′ with the reduced axial portion 42′ of the control shaft 34 circumferentially slidably received on the inner surface of the rounded or semicircularly curved end portion of the retaining member 46′ though not shown in the drawings. Where further desired, the control shaft 34 may be provided with a second disc member which is arranged to be in slidable contact with the inner face of the end wall portion 16′ of the support member 10 similarly to the previously described disc member 40 though not shown in the drawings so as to provide enhanced assurance of the control shaft 34 being prevented from axially moving from its initial position relative to the support member 10.

Figure 4:
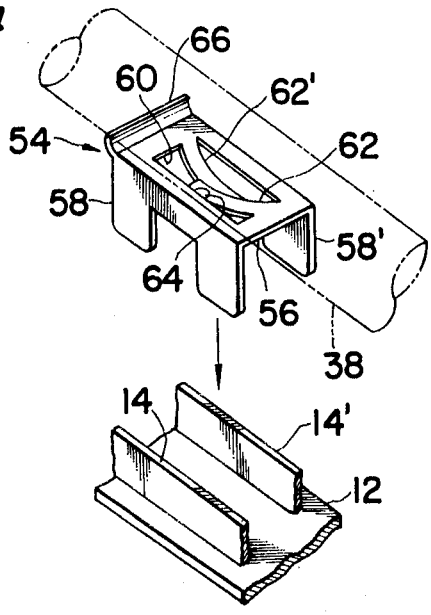
FIG. 4 is a perspective view which shows a preferred example of the detailed configuration of a slider also incorporated into the variable resistor device illustrated in FIGS. 1 and 2.

The variable resistor device shown in FIGS. 1 to 4 further comprises a slider 54 the construction of which is best seen in FIG. 4. The slider 54 is in its entirety formed of an electrically conductive and mechanically elastic material and has a main wall portion 56 and a pair of parallel side wall portions 58 and 58′ which project substantially perpendicularly from the longitudinal edges of the main wall portion 56 and which are spaced apart from each other a distance substantially equal to or appreciably larger than the distance between the outer lateral faces of the guide rail portions 14 and 14′ on the inner or upper face of the base wall portion 12 of the support member 10. The main wall portion 56 of the slider 54 is partly removed to form a generally rectangular opening 60 and to leave a pair of strip portions 62 and 62' which are in staggered relationship to each other and which have substantially equal lengths larger than one half of the length of the generally rectangular opening 60. The two strip portions 62 and 62' are securely connected together at their respective leading ends by suitable fastening means 64. Because length of each of the strip portions 62 and 62' is larger than one half of the length of the generally rectangular opening 60 and due to the resiliency of material constituting the slider 54, the strip portions 62 and 62' are elastically deformed or warped inwardly of the slider 54 and thus has their interconnected end portions projecting from the plane defined by the inner face of the main wall portion 56 as will be seen from FIG. 4. The slider 54 is further formed with a lateral projection 66 projecting from one longitudinal end of the main wall portion 56 in a direction opposite to the side wall portions 58 and 58'. Although the slider 54 has been thus far assumed to be of a unitary construction, some or all of the above described portions constituting the slider may be formed separately of each other and combined together by suitable fastening means if desired. If, in this instance, the strip portions 62 and 62' are to be formed separately of the main wall portion 56, the portions except for the strip portions 62 and 62' may be formed of a rigid material if the strip portions 62 and 62' are formed of an elastic material.

The slider 54 is longitudinally slidably mounted on the support member 10 in such a manner that the side wall portions 58 and 58' thereof are in slidable contact with the outer lateral faces of the guide rail portions 14 and 14' of the support member 10 with the inner or, as shown in FIG. 4, upper face of the main wall portion 56 slidably received on the tops of the guide rail portions 14 and 14' and/or with the longitudinal free edges of the side wall portions 58 and 58' slidably received on the inner or upper face of the base wall portion 12 of the support member 10. With the slider 54 thus engaging the guide rail portions 14 and 14' of the support member 10, the interconnected end portions of the warped strip portions 62 and 62' are elastically forced against the elongate resistance element 30 underlying the main wall portion 56 of the slider 54 whereas the lateral projection 66 has its lateral edge held in mating engagement with the threaded axial portion 38 of the control shaft 34 which overlies the slider 54 as will be understood from the illustration of FIG. 2.

The variable resistor device embodying the present invention further comprises a unitary casing member 68 formed of an electrically insulating material. As best seen in FIG. 3, the casing member 68 has an elongate main wall portion 70 and a pair of spaced parallel side wall portions 72 and 72' projecting substantially perpendicularly from the longitudinal edges of the main wall portion and spaced apart from each other a distance appreciably larger than the distance between the outer faces of the side wall portions 72 and 72' of the slider 54. The heights of the side wall portions 72 and 72' are such that the side wall portions are in close contact at their top ends with the flat edges 24 and 24' of the side projections 22 and 22', respectively, of the end wall portion 16 and also those of the end wall portion 16' and at their lower ends with the upper faces of the longitudinal edge portions of the base wall portion 12 of the support member 10. The side wall portions 72 and 72' are, moreover, appreciably longer than the distance between the outer faces of the end wall portions 16 and 16' of the support member 10. On the other hand, the elongate main wall portion 70 of the casing member 68 has a length which is substantially equal to the distance between the inner faces of the end wall portions 16 and 16' of the support member 10 so that, when the casing member 68 is mounted on the support member 10 in a manner above described, the elongate main wall portion 70 of the casing member 68 has its longitudinal ends held in close contact with the inner faces of the end wall portions 16 and 16', as will be understood from FIG. 2 so that the casing member 68 is, in its entirety, closely fitted to the support member 10. The main wall portion 70 of the casing member 68 has an inner or, in the illustration of FIG. 3, lower face which is so arranged as to be in loose contact with the top end of the circumferential edge of the disc member 40 on the control shaft 34 so that the control shaft 34 is held in position relative to the support and casing members 10 and 68 no only through engagement between the reduced axial portion 42 of the shaft 34 and the rounded or semicircularly curved end portion 50 of the retaining member 46 but through abutting engagement of the disc member 40 with the inner or lower face of the main wall portion 70 of the casing member 68. The main wall portion 70 of the casing member 68 is, furthermore, formed with a projection 74 which projects downwardly from the inner or lower face of the main wall portion 70 and which is located in proximity to the lingitudinal end of the wall portion 70 to contact the end wall portion 16 of the support member 10. The projection 74 is off set from the longitudinal end of the main wall portion 70 a distance substantially equal to or appreciably larger than the thickness of the disc member 40 on the control shaft 34 so that the disc member 40 has one face in slidable contact with the inner face of the end wall portion 16 of the support member 10 as previously mentioned and the other face in slidable contact with the projection 74. The control shaft 34 is in this manner held in axial position relative to the support and casing members 10 and 68 not only through engagement of its reduced axial portion 42 with the retaining member 46 but through engagement of the disc member 40 with the end wall portion 16 of the support member 10 and the projection 74 on the main wall portion 70 of the casing member 68. The casing member 68 has been assumed to be of unitary construction, the main wall portion 70, the side wall portions 72 and 72' and/or the projection 74 may be formed separately of each other and connected together by suitable fastening means, if desired.

The variable resistor device thus composed of the support member 10, the resistance element 30, the control shaft 34, the retaining member 46, the slider 54 and the casing member 68 is assembled in the following steps.

The elongate resistance element 30 is first fixed to the inner or upper face of the base wall portion 12 of the support member 10 by means of the fittings 32 and 32'. The fittings 32 and 32', which may be screws or studs, may be fitted to the base portion 12 of the support member 10 in such a manner that the leading end portions thereof project outwardly from the outer or lower face of the base wall portion 12 as seen in FIGS. 1 and 2 for thereby providing ease of connection to the lead wires located externally of the variable resistor device. The slider 54 is then fitted to the support member 10 with its side wall portions 58 and 58' in slidable contact with the outer faces of the guide rail portions 14 and 14' of the support member 10 and with the inner or lower face of the main wall portion 56 in slidable contact with the top edges of the guide rail portions 14 and 14' and/or the lower edges of the side wall portions 58 and 58' in slidable contact with the upper face of the base wall portion 12 depending upon the relation between the heights of the guide rail portions 14 and 14' of the support member 10 and the heights of the side wall portions 58 and 58' of the slider 54. The slider 54 being fitted to the support member 10 in this manner, the interconnecting ends of the strip portions 62 and 62' of the slider 54 and elastically forced against the underlying resistance element 30. Thereafter, the control shaft 34 is mounted on the support member 10 in such a manner that the disc member 40 carried by the shaft 34 is held in contact with the inner face of the end wall portion 16 of the support member 10 with the first and second journal portions 36 and 36' resting on the semicircularly curved edges 20 and 20' of the end wall portions 16 and 16', respectively, and that the lateral projection 66 of the slider 54 has its edge received between neighbouring two of the helithreads of the threaded axial portion 38 of the control shaft 34. The retaining member 46 is then inserted through the opening 28 in the projection 26 of the end wall portion 16 of the support member 10 by manually depressing the parallel arm portions 48 and 48' toward each other so that the sidewise outwardly bent or protruded sections 52 and 52' of the retaining member 46 are passed through the opening 28. With the bent or protruded sections 52 and 52' thus passed through the opening 28, the retaining member 46 is snugly fitted to the projection 26 of the end wall portion 16 by virtue of the engagement between the flat upper faces of the bent or protruded sections 52 and 52' and the lower face of the projection 26 when the external force applied to the arm portions 48 and 48' is removed. The reduced axial portion 42 of the control shaft 34 is now captured by the rounded or semicircularly curved end portion 50 of the retaining member 46 so that the control shaft 34 is prevented from being axially moved from the initial position relative to the support member 10. The casing member 68 is then mounted on the support member 10 in such a manner that the main wall portion 70 is in close contact with the inner faces of the end wall portions 16 and 16' of the support member 10 and that the side wall portions 72 and 72' are closely engaged at their upper ends by the flat lower edges 24 and 24' of the side projections 22 and 22' of the end wall portion 16 and those of the end wall portion 16' and at their lower ends by the upper face of the base wall portion 12 of the support member 10. With the casing member 68 thus fitted to the support member 10, the disc member 40 on the control shaft 34 is in contact with the inner or lower face of the main wall portion 70 of the casing member 68 and has its inner face in contact with the projection 74 on the inner or lower face of the portion 70.

When, in operation, the control shaft 34 is driven for rotation about its axis from the control knob 44, the slider 54 is longitudinally moved a distance corresponding to an angle of rotation of the shaft 34 through engagement between the threaded axial portion 38 of the shaft 34 and the edge of the lateral projection 66 of the slider 54. The interconnected end portions of the strip portions 62 and 62' of the slider 54 are consequently moved on the elongated resistance element 30 on the base wall portion 12 of the support member 10 in a direction corresponding to the direction of rotation of the control shaft 34 and through a distance corresponding to the angle of rotation of the shaft 34. The effective resistance between one of the fittings or terminals 32 and 32' and the slider 54 is in this manner varied depending upon the direction and angle of rotation of the control shaft 34. Electrical conduction is thus established between one of the fittings 32 and 32', the resistance element 30, the strips 62 and 62' and the lateral projection 66 of the slider 54, the threaded and reduced axial portions 38 and 42 of the control shaft 34, and the retaining member 46.

FIGS. 5*a*, 5*b* and 5*c* illustrate alternative examples 76, 78, and 80, respectively, of the retaining member forming part of the variable resistor device embodying the present invention. The retaining member 76 shown in FIG. 5*a* is similar in configuration to the retaining member 46 illustrated in FIG. 3 but is formed of a rod or wire having a circular cross section. The retaining member 76 thus has a pair of spaced parallel arm portions 82 and 82' formed with sidewise outwardly bent or protruded sections 84 and 84', respectively, and a rounded or semicircularly curved end portion 86 through which the arm portions 82 and 82' merge into each other. The retaining member 78 illustrated in FIG. 5*b* consists of a pair of spaced parallel side wall portions 88 and 88' and a rounded or semicircularly curved end portion 90 through which the side wall portions 88 and 88' are connected to each other at their top ends. The side wall portions 88 and 88' are formed with sidewise outwardly bent or protruded sections 92 and 92', respectively. The bent or protruded sections 92 and 92' have their top ends outwardly spaced apart from the outer faces of the side wall portions 88 and 88' and are downwardly inclined toward the outer faces of the side wall portions 88 and 88'. The retaining member 78 is formed of an elastic material and is, thus, the side wall portions 88 and 88' are elastically forced toward each other and the bent or protruded sections 92 and 92' elastically forced toward the planes respectively defined by the outer faces of the side wall portions 88 and 88' when the retaining member 78 is laterally contracted when the bent or protruded sections 92 and 92' are depressed toward each other. The side wall portions 88 and 88' have widths which are substantially equal to the axial length of the reduced axial portion 42 of the control shaft 34 and have their top edges 96 and 96' which are inclined slightly downwardly from their ends joining the rounded or semicircularly curved end portion 90 When the retaining member 78 thus constructed and arranged is press fitted to the projection 26 of the end wall portion 16 of the support member 10 shown in FIG. 3 through the opening 28 formed in the projection 26, the sidewide outwardly bent or protruded section 92 and 92' have their top ends in close contact with the lower face of the projection 26 so that the retaining member 78 is securely captured by the projection 2 and is this prevented from being removed or dislodge therefrom. With the retaining member 78 held in such a condition, the reduced axial portion 42 of the control shaft 34 is partly received in the rounded or semicircularly curved end portion 90 of the retaining member 7 and partly engaged or seized by the downwardly slanting top edges 96 and 96' of the side wall portions 8 and 88' of the retaining member 78. Referring to FIG 5*c*, the retaining member 80 is shown to comprise pair of spaced arm portions 98 and 98' connected at their top ends by an end portion 100. The arm portions 98 and 98' have respective intermediate sections 102 and 102', respectively, which are warped in directions normal to the faces of the arm portions 98 and 98'. The end portion 100 of the retaining member 80 is formed with a projection 104 which is appropriately angled to the arm portions 98 and 98'. The retaining member 80 is formed of an elastic, electrically conductive material. When the retaining member 80 thus configured is press fitted into the opening 28 in the projection 26 of the end wall portion 16 of the support member 10, the warped intermediate sections 102 and 102' of the arm portions 98 and 98' are deformed in the opening 28 so that, when the intermediate sections 102 and 102' are passed through the opening 28, the arm portions 98 and 98' are snugly fitted to the projection 26 of the end wall portion 16 (see FIG. 3). With the retaining member 80 held in this position, the projection 104 of the end portion 100 of the retaining member 80 is held in abutting engagement at its edge with the end face of the first journal portion 36 of the control shaft 34 and thus urges the control shaft 34 in a direction in which the disc member 40 is forced toward the projection 74 on the inner or lower face of the main wall portion 70 of the casing member 68, thereby holding the control shaft 34 in a predetermined axial position relative to the support and casing members 10 and 68. The configurations of the retaining members thus far described with reference to FIGS. 5*a*, 5*b* and 5*c* are merely for the purpose of illustration and may therefore be changed and/or modified in numerous manners if desired.

FIG. 6 illustrates a modification of the slider incorporated into the variable resistor device embodying the present invention. While the slider 54 shown in FIG. 4 is arranged in such a manner as to straddle on the guide rail portions 14 and 14' on the base wall portion 12 of the support member 10, the modified slider, designated by reference numeral 106, has spaced parallel side wall portions 108 and 108' which project perpendicularly from the longitudinal edges of the main wall portion 56 away from the underlying upper or inner face of the base wall portion 12 of the support member 10 and which are longitudinally slidably received on the inner faces of the guide rail portions 14 and 14', respectively, of the suport member 10. The longitudinal free edges of the side wall portions 108 and 108' of the slider 106 are, thus, slidable on the inner or lower faces of the main wall portion 70 of the casing member 68. The main wall portion 56 of the slider 106 is arranged similarly to that of the slider 54 shown in FIG. 4 and is, thus, formed with strip portions (only one of which is seen as at 62 in FIG. 6) which are interconnected at their leading ends and which are elastically warped toward the inner or upper face of the base wall portion 12 of the support member 10 so that the interconnected ends of the strip portions are in slidable contact with the elongate resistance element 30 on the inner or upper face of the base wall portion 12 (see FIG. 7). The main wall portion 56 of the slider 106 underlies the threaded axial portion 38 of the control shaft 34 and is also formed with a lateral projection 66 having its edge constantly held in mating contact with the threaded axial portion 38 of the control shaft 34 for providing electrical connection between the resistance element 30 and the control shaft 34 as in the case of the arrangement shown in FIG. 4.

FIG. 8 illustrates another example of the slider incorporated into the device according to the present invention. The slider, now designated by reference numeral 110, consists of a unitary strip having first and second enlarged end portions 112 and 114 and an arcuately curved intermediate portion 116 interconnecting the enlarged end portions 112 and 114 and is formed of an elastic, electrically conductive material. The first enlarged end portion 112 of the slider 110 is formed with an approximately elliptic opening 118 which is elongated longitudinally of the end portion 112 and which is defined in part by a substantially semicircular edge 118*a* located adjacent to the free longitudinal end of the end portion 112 and in part by a curved edge 118*b* located opposite to the semicircular edge 118*a*. The semicircular edge 118*a* is adapted to be in mating engagement with the threaded axial portion 38 of the control shaft 34 as illustrated. The second enlarged end portion 114 has a substantially flat face which is adapted to be in slidable contact with the threaded axial portion 38 of the control shaft 34. The arcuately warped intermediate portion 116 has formed at its top an outward projection 120 which is adapted to be elastically forced against the resistance element 30 when the retaining member 110 is engaged by the threaded axial portion 38 of the control shaft 34. As will be seen from FIG. 9 as well as FIG. 8, the control shaft 34 is inserted through the opening 118 in the first enlarged end portion 112 of the retaining member 110 so that the semicircular edge 118*a* defining part of the opening 118 is in mating engagement with the upper end of the threaded axial portion 38 of the control shaft 34 whereas the second enlarged end portion 114 has its flat face received on the lower end of the threaded axial portion 38 of the control shaft 34. With the first and second enlarged end portions 112 and 114 thus engaged by the threaded axial portion 38 of the control shaft 34, the outward projection 120 of the warped intermediate portion 116 of the retaining member 110 is elastically forced against the elongate resistance element 30 on the inner or upper face of the base wall portion 12 of the support member 10 as will be seen from FIGS. 8 and 9. When the control shaft 34 is driven to rotate about its axis, the retaining member 110 is in its entirety moved in parallel with the axis of the control shaft 34 through mating engagement between the semicircular edge 118*a* of the first enlarged end portion 112 and the threaded portion 38 of the control shaft 34 with the second enlarged end portion in sliding contact with the threaded axial portion 38 so that the outward or downward projection 120 of the warped intermediate portion 116 of the retaining member 110 is caused to longitudinally slide on the upper face of the elongate resistance element 30 on the inner or upper face of the base wall portion 12 of the support member 10.

From the foregoing description it will be appreciated that the variable resistor device according to the present invention has advantages which include:

1. Ease of assemblage because all the component parts to be assembled to the support member can be readily fitted to the support member by moving the parts substantially in the same directions toward the inner or, as shown in the drawings, upper face of the base wall portion of the support member and because the component parts such as the retaining member, the slider and the casing member can be press fitted to the support member, contributing to reduction of the number of steps required for the assemblage and the production cost of the variable resistor device.

2. Simplicity of construction because the support and casing members and the slider making up the resistor device can be constituted as unitary members and particularly because the slider can be supported in slidable engagement with the control shaft and the resistance element without use of any extra support means which might give rise to the number of component parts, the number of steps for assemblage and accordingly the production cost of the resistor device.

3. Reliability of operation providing stabilized resistance variation characteristics, because of the fact that the control shaft is constantly maintained in its initial position relative to the support member and the casing member and is thus prevented from being dislodged either in axial direction or in radial direction from the initial position.

4. Stable electrical connection established between the resistance element and the control shaft with the slider elastically held in engagement on one hand with the resistance element and on the other hand with the control shaft.

5. No extra conductors required for providing conduction between the slider and the output terminal of the resistor device because such conduction is provided by means of the control shaft and the retainer which have not only mechanical functions but functions to provide electrical connection between the slider and the output terminal or lead of the resistor device.

6. Substantially totally enclosed dust-proof construction with the casing member snugly fitted to the support member.

Having thus described the embodiment of the present invention and some modifications thereof, it should be borne in mind that the embodiment and the modifications thereof are merely for the purpose of illustration and that the present invention may be modified in numerous manners without departing from the spirit and scope of the invention.

What is claimed is:

1. A variable resistor device comprising: an electrically non-conductive support member having a base wall portion and a pair of end wall portions substantially perpendicular to the inner face of the base wall portion and each formed with an elongate recess extending substantially perpendicularly to the inner face of said base wall portion from the free end of each end wall portion and terminating with a substantially semicircularly curved edge; an elongate resistance element extending longitudinally of said base wall portion and fixedly secured to the base wall portion; an electrically conductive rotatable control shaft received on the semicircular curved edges of said end wall portions and having a threaded axial portion extending over and substantially in parallel with said resistance element; first and second terminal elements connected to the longitudinal ends of the resistance element and secured to said non-conductive support member; electrically conductive retaining means for snugly releasably retaining said control shaft in position relative to said support member while permitting the control shaft to rotate about its axis, said retaining means including a third terminal element which is in constant contact with said control shaft; and an electrically conductive slider having an elastic contact portion elastically forced against the longitudinally slidable on and along said resistance element and having a lateral edge portion in engagement with said threaded axial portion of said control shaft.

2. A variable resistor device according to claim 1, further comprising an electrically non-conductive casing member snugly and releasably fitted to said support member in a direction substantially normal to the inner face of said base wall portion of said support member for enclosing said resistance element, said threaded axial portion of said control shaft and said slider within the casing member and said support member.

3. A variable resistor device according to claim 1, in which said control shaft is formed with a reduced axial portion projecting outwardly from the outer face of at least one of said end wall portions of the support member and in which said retaining means comprises an elastically deformable, electrically conductive retaining member having spaced portions snugly and releasably fitted to said at least one of said end wall portions of said support member and an end portion having a substantially semicircularly curved part on which said reduced axial portion of the control shaft is circumferentially slidably received, said retaining member constituting said third terminal element.

4. A variable resistor device according to claim 3, in which said at least one of said end wall portions of the support member has a projection formed with an opening which is substantially aligned with said reduced axial portion of the control shaft and in which said spaced portions of the retaining member are partly received with their leading ends projecting out of said opening.

5. A variable resistor device according to claim 4, in which said spaced portions of said retaining member merge into each other through said end portion of the retaining member.

6. A variable resistor device according to claim 5, in which each of said spaced portions of said retaining member is formed with a protuded section which projectd out of said opening in said projection of said at least one of said end wall portions of the support member and which is in close engagement with said projection so that the retaining member is releasably yet snugly captured by the projection.

7. A variable resistor device according to claim 6, in which said protruded section is protruded laterally outwardly from a side face of each of said spaced portions of the retaining member.

8. A variable resistor device according to claim 6, in which said protruded section is protruded in a direction substantially parallel to the axis of said control shaft.

9. A variable resistor device according to claim 5, in which said end portion of said retaining member receives thereon substantially the entire axial length of said reduced axial portion of said control shaft.

10. A variable resistor device according to claim 5, in which said end portion of said retaining member receives thereon part of the axial length of said reduced axial portion of said control shaft.

11. A variable resistor device according to claim 10, in which said spaced portions of said retaining member have respective edge portions between which said reduced axial portion of said control shaft is circumferentially slidably received over the remaining axial length thereof.

12. A variable resistor device according to claim 10, in which said end portion of said retaining member has a projection which is in slidable contact with an annular face at one axial end of said reduced axial portion of said control shaft.

13. A variable resistor device according to claim 1, in which said support member further has a pair of spaced parallel guide rail portions on the inner face of said base wall portion and extending substantially in parallel with and on both sides of said resistance element and in which said slider has a main wall portion substantially parallel to the inner face of the base wall portion of the support member and formed with said contact portion and a pair of side wall portions substantially perpendicular to said main wall portion and respectively in longitudinally slidable contact with said guide rail portions of the support member.

14. A variable resistor device according to claim 13, in which said side wall portions of said slider are in contact with the outer side faces of said guide rail portions of said support member.

15. A variable resistor device according to claim 14, in which said side wall portions of said slider have their free longitudinal edges in slidable contact with the inner face of said base wall portion of said support member.

16. A variable resistor device according to claim 14, in which said main wall portion of said slider has an inner face in longitudinally slidable contact with the top faces of said guide rail portions of said support member.

17. A variable resistor device according to claim 13, in which said side wall portions of said slider are respectively in contact with the inner side faces of said guide rail portions of said support member.

18. A variable resistor device according to claim 17, further comprising an electrically non-conductive casing member snugly and releasably fitted to said support member in a direction perpendicular to the inner face of said base wall portion of said support member for enclosing said resistance element, said threaded axial portion of said control shaft and slider within the casing member and said support member, said casing member having a main wall portion extending over said threaded axial portion of said control shaft and said side wall portions of said slider having free longitudinal edges in slidable contact with the inner face of said main wall portion of said casing member.

19. A variable resistor device according to claim 13, in which said main wall portion of said slider is formed with an opening shaped to form a pair of strip portions arcuately extending toward said resistance element and interconnected at their leading ends for forming said contact portion.

20. A variable resistor device according to claim 19, in which said strip portions are formed of an elastic, electrically conductive material.

21. A variable resistor device according to claim 1, in which said slider consists essentially of an elastic strip comprising a first end portion formed with an opening partly defined by said edge portion of the slider, a second end portion having a substantially flat face in slidable contact with the threaded axial portion of the control shaft, and an arcuately warped intermediate portion interconnecting said first and second end portions and formed at its top with said contact portion.

22. A variable resistor device according to claim 1, in which said control shaft has fixedly carried thereon a disc member which is in slidable contact with the inner face of said at least one of the side wall portions of said support member.

23. A variable resistor device according to claim 1, further comprising an electrically non-conductive casing member snugly fitted to said support member and enclosing said resistance element, said threaded axial portion of said control shaft and said slider within the casing member and said support member, said casing member having a main wall portion having a longitudinal end in close contact with the inner face of each of said end wall portions of said support member.

24. A variable resistor according to claim 23, in which said main wall portion of said casing member is formed with a projection on its inner face and in which said control shaft has fixedly carried thereon a disc member one face of which is in slidable contact with the inner face of said at least one of the end wall portions of said support member and the other face of which is in slidable contact with said projection of the main wall portion of said casing member.

25. A variable resistor device according to claim 24, in which said control shaft is formed with a reduced axial portion projecting outwardly from an outer face of said at least one of the end wall portions of said support member and in which said retaining means comprises an elastically deformable, electrically conductive retaining member having spaced portions snugly and releasably fitted to said end wall portion of the support member and an end portion having a substantially semicircularly cirved part on which said reduced axial portion of the control shaft is circumferentially slidably received, said retaining member constituting said third terminal element.

* * * * *